United States Patent [19]

Kasari

[11] Patent Number: 4,781,949

[45] Date of Patent: Nov. 1, 1988

[54] METALLIC COATING METHOD

[75] Inventor: Akira Kasari, Hiratsuka, Japan

[73] Assignee: Kansai Paint Company, Limited, Hyogo, Japan

[21] Appl. No.: 20,183

[22] Filed: Feb. 27, 1987

Related U.S. Application Data

[63] Continuation of Ser. No. 750,359, Jul. 1, 1985, abandoned.

[30] Foreign Application Priority Data

Jul. 11, 1984 [JP] Japan ..... 59-144875

[51] Int. Cl.[4] ..... B05D 1/36

[52] U.S. Cl. ..... 427/407.1; 427/409

[58] Field of Search ..... 427/409, 407.1, 27, 427/385.5

[56] References Cited

U.S. PATENT DOCUMENTS

| | | | |
|---|---|---|---|
| 3,639,147 | 2/1972 | Benefiel et al. | 427/393.6 X |
| 4,139,672 | 2/1979 | Ozawa et al. | 427/409 X |
| 4,208,465 | 6/1980 | Chang | 427/410 X |
| 4,220,675 | 9/1980 | Imazaki | 427/409 X |
| 4,347,277 | 8/1982 | Slama et al. | 427/410 X |
| 4,391,858 | 7/1983 | Batzill | 427/407.1 |
| 4,433,014 | 2/1984 | Gaske et al. | 427/410 X |
| 4,463,038 | 7/1984 | Takeuchi et al. | 427/407.1 |

FOREIGN PATENT DOCUMENTS

| | | |
|---|---|---|
| 2938308 | 4/1981 | Fed. Rep. of Germany . |
| 3111478 | 10/1982 | Fed. Rep. of Germany . |
| 3240043 | 5/1983 | Fed. Rep. of Germany . |

*Primary Examiner*—Thurman K. Page

*Attorney, Agent, or Firm*—Armstrong, Nikaido, Marmelstein & Kubovcik

[57] ABSTRACT

This invention provides a metallic coating method comprising the steps of applying a thermosetting polymer coating composition containing no metallic flake pigment to an article to be coated to form a first layer, applying a high solids thermosetting polymer metallic coating composition to the first layer to form a second layer while the first layer retains a viscosity of about 3 to about 500 poises at 20° C., applying a clear thermosetting polymer coating composition to the second layer to form a third layer and heating the coated article to cure the three layers at the same time.

12 Claims, No Drawings

METALLIC COATING METHOD

This application is a continuation of application Ser. No. 750,359 filed 7/1/85 and now abandoned.

This invention relates to a metallic coating method and more particularly to a novel metallic coating method using a high solids thermosetting metallic coating composition.

Metallic coatings glitter upon reflection of incident light rays by the metallic flake pigment present in the coating and have a unique appearance with the color of coating rich in tone. Such metallic coatings find frequent use particularly in coating the exteriors of automobiles, motorcycles and the like.

Metallic coatings have been obtained by various methods in which a metallic coating composition containing a metallic flake pigment is applied to an article to be coated: for example (i) those in which a metallic coating composition is applied and thermally cured, namely methods comprising one coating step and one baking step; (ii) those in which a metallic coating composition is applied and thermally cured, and the coat thus formed is further coated with a clear coating composition whereupon the finish clear coat is thermally cured, namely methods comprising two coating steps and two baking steps; (iii) those in which a metallic coating composition and clear coating composition are applied in this order to form two layers which are thermally cured at one time, namely methods comprising two coating steps and one baking step; (iv) and those in which a clear coating composition is applied over the two layers formed by the system of two coating steps and one baking step and is thermally cured, namely methods comprising three coating steps and two baking steps. Of these methods, the 2-coating and 1 baking-step system has been most frequently employed, considering diverse factors such as the number of coating steps, appearance of finish metallic coat, properties of coats, etc.

Metallic coatings capable of producing a uniformly metallike effect free from the mottle of simulated metallic texture and having distinctness-of-image gloss are produced presumably due to the metallic flake pigment being oriented in parallel with the coating surface, uniformly and regularly over the entire coating surface and because of the outstanding surface smoothness of the metallic coating.

In order to fulfill the foregoing requirements, it is considered preferable to use a metallic coating composition which has a high viscosity after application to prevent the flow of metallic flake pigment and which is capable of producing a coat with a thickness greatly different between immediately after application and after curing to facilitate the uniform and regular orientation of pigment in parallel with the coating surface over the entire coating surface and to give a smooth surface to the coating, whereby a coating is formed free from the mottle of simulated metallic texture and with distinctness-of-image gloss. For this purpose, conventional coating methods have used metallic coating compositions containing higher molecularweight resin and/or suitable additives to increase the viscosity, and a larger amount of organic solvent to give a lower solids content of generally as low as about 20 to about 30% by weight, thereby leading to a coating significantly different in the thickness between immediately after application and after curing.

There remains important problems to prevent air pollution and to save resources in the area of coating technologies involving the handling of organic solvents in large amounts. These problems can be overcome by using high solids coating compositions with the lowest possible content of organic solvent. In this situation, it is desired in the art to develop metallic coating methods using high solids metallic coating compositions suitable for this purpose.

However, metallic coatings can not be produced with good results by conventional methods using high solids metallic coating compositions. This is because known high solids metallic coating compositions have the drawbacks that although having a high viscosity, the compositions form a coat having a thickness which is small in difference between immediately after application and after curing, whereby improper orientation of metallic flake pigment is caused in the coat, leading to mottles of simulated metallic texture and a less smooth surface is imparted to the coating, failing to give distinctness-of-image gloss to the coating.

At present, there is a great need for novel methods of forming metallic coatings by using high solids metallic coating compositions free from the foregoing drawbacks.

An object of this invention is to provide a novel metallic coating method using a high solids metallic coating composition with good results.

Another object of the invention is to provide a novel metallic coating method using a high solids metallic coating composition and capable of preventing air pollution and saving resources.

A further object of the invention is to provide a novel metallic coating method using a high solids metallic coating composition and capable of giving metallic coatings free from the mottle of simulated metallic texture and having distinctness-of-image gloss.

These and other objects of this invention will become apparent from the following description.

This invention provides a metallic coating method comprising the steps of applying a thermosetting coating composition containing no metallic flake pigment (hereinafter referred to as "nonmetallic coating composition") to an article to be coated to form a first layer, applying a high solids thermosetting metallic coating composition to the first layer to form a second layer while the first layer retains a viscosity of about 3 to about 500 poises at 20° C., applying a clear thermosetting coating composition to the second layer to form a third layer and heating the coated article to cure the three layers at the same time.

We have found that when the nonmetallic coating composition is first applied to an article to be coated to form a first layer and the high solids thermosetting metallic coating composition is applied to the wet surface of the first layer which retains the viscosity in the above-specified range, the metallic flake pigment is caused to orient in parallel with the coating surface, uniformly and regularly over the entire coating surface without flow of the metallic flake pigment and the metallic coating surface is given improved smoothness due to the excellence of metallic coating composition in wetting at and in amenability to the surface of the first layer having the specific viscosity. Accordingly, the methods of this invention give coatings capable of providing uniformly metallike effect free from the mottle of simulated metallic texture and having distinctness-of-image gloss. If the high solids metallic coating composition is applied directly to an article to be coated without applying thereto the nonmetallic coating composition, improper orientation of metallic flake pigment results, and a smooth surface can not be produced over the coating; in short, the results contemplated in this invention can not be obtained.

The coating compositions to be used in the present invention and the methods of forming metallic coatings using the compositions will be described below in detail.

(1) Thermosetting Coating Composition Containing No Metallic Flake Pigment According to this Invention (Nonmetallic Coating Composition)

The nonmetallic coating composition is a thermosetting one free of metallic flake pigment and is used to uniformly orient in parallel with the coating surface the metallic flake pigment present in the high solids thermosetting metallic coating composition to be subsequently applied and to give a smooth surface to the resulting metallic coat. The presence of metallic flake pigment in the nonmetallic coating composition results in coating in which an impaired metallike effect is achieved by the high solids thermosetting metallic coating composition, hence being undesirable.

More specifically, the nonmetallic coating composition is a conventional thermosetting one free of metallic flake pigment, and comprises a thermosetting resin composition and an organic solvent as the main components and, when required, additives such as a coloring pigment, extender pigment, viscosity modifier, coating surface modifier, etc. Suitable examples of the thermosetting resin composition are mixtures of base resins selected from alkyd resins, polyester resins, acrylic resins, cellulose-type resins and the like, and cross linking agents selected from amino resins, isocyanate resins (including those of blocked isocyanate) and the like. The base resins and cross linking agents useful in this invention are those known in the art. The nonmetallic coating composition may be in the form of either an organic solution or a nonaqueous dispersion.

To prevent air pollution and save resources which is among the objects of this invention, the nonmetallic coating compositions may be of high solids type. The solids concentration thereof is in the range of preferably about 35 to about 70% by weight, or more preferably about 40 to about 60% by weight. The conversion into a high solids coating composition can be achieved by treating the thermosetting resin composition in a conventional manner, e.g., by lowering the molecular weight or the glass transition temperature of the resin in the resin composition. The high solids nonmetallic coating composition can be obtained for example by dissolving or dispersing in aromatic or aliphatic organic solvent a thermosetting acrylic resin composition comprising about 50 to about 90% by weight of acrylic resin (base resin) having a molecular weight of 5000 to 20000 and a glass transition temperature of −30° to 50° C. and about 10 to about 50% by weight of alcohol-modified melamine resin (cross linking agent) to give a solids concentration in the above-specified range and a viscosity of about 15 to about 60 seconds (Ford cup #4/20° C.).

The nonmetallic coating composition can be applied either directly to the surface of an article to be coated or to the primer of electrophoretic coating composition or the intercoat over the primer on the article to be coated. Preferred coaters useful in application of the nonmetallic coating composition include those of atomizing type such as air spray, air-less spray and electrostatic coater of air-atomizing type or rotation type. The nonmetallic coating composition is preferably adjusted to a viscosity of about 15 to about 60 seconds, more preferably about 15 to about 35 seconds in terms of Ford cup #4 at 20° C. The coating formed preferably ranges in thickness from about 2 to about 20μ, particularly from about 5 to about 15μ, when thermally cured.

According to this invention, it is critical that the high solids thermosetting metallic coating composition be applied to the wet coating formed of the nonmetallic coating composition while the wet coating retains a viscosity of about 3 to about 500 poises, preferably about 5 to about 100 poises, more preferably about 10 to about 50 poises, at 20° C. The high solids thermosetting metallic coating composition applied to the coating having a viscosity of less than 3 poises tends to run and to unevenly orient the metallic flake pigment, hence being undesirable. Also the metallic coating composition applied to the coating higher than 500 poises in viscosity is less likely to orient the metallic flake pigment in parallel with the coating surface and is prone to give a lower smoothness to the coating surface, hence being undesirable.

The viscosity of the nonmetallic coating composition after application was measured in this invention by applying the nonmetallic coating composition to a tinplate by the foregoing method (preferably under conditions most conforming to practical factors), collecting the coating in a glass bottle and determining the viscosity (poise) at 20° C. and at a shear rate of 10 $sec^{-1}$ with use of a viscometer of the corn and plate type.

The viscosity of the nonmetallic coating composition after application can be easily adjusted by suitably regulating the solids concentration of the nonmetallic coating composition to be applied, formulation of the solvent, viscosity of the composition and the like. The viscosity of the nonmetallic coating composition which is lower immediately after application than in the specific range can be regulated by standing of the composition at room temperature or preheating to evaporate off the solvent and the like. The interval between the application of nonmetallic coating composition and application of the high thermosetting metallic coating composition may be minimized by adequately incorporating a viscosity modifier into the nonmetallic coating composition to bring the viscosity into the above range immediately after application of nonmetallic coating composition. Useful viscosity modifiers include, for example, "Bentone 27" (trademark, product of NL Chemical Co., Ltd., Japan), "Aerosil #200" (trademark, a product of Nippon Aerosil Co., Ltd., Japan) and the like.

(2) High Solids Thermosetting Metallic Coating Composition According to this Invention (High Solids Metallic Coating Composition)

The high metallic coating composition is applied to the layer of nonmetallic coating composition maintaining the viscosity in the specific range. The high solids metallic coating composition comprises a thermosetting resin composition, metallic flake pigment and organic solvent as the main components, and if required, a coloring pigment, extender pigment, coating surface modifier, viscosity modifier and the like.

The high solids metallic coating composition to be used in this invention can be one having a higher solids content than that of the conventional metallic coating compositions which is inevitably at a low level. The solids concentration of high soilds metallic coating composition may be in the range of about 35 to about 70% by weight, preferably about 40 to about 60% by weight, more preferably about 40 to about 53% by weight, giving all-embracing consideration to the prevention of air pollution, saving of resources, coating efficiency, appearance of finish exterior, etc. According to this invention, metallic coating can be formed with good results by using the high solids metallic coating composition which has been heretofore considered to involve difficulties in giving coats capable of producing uniformly metallike effect and having distinctness-of-image gloss.

As examples of the thermosetting resin composition which can be used in the high soilds metallic coating composition may be mentioned those exemplified above for the nonmetallic coating composition. Useful metallic flake pigments can be any of those known in the art such as metallic flakes of aluminum, copper, brass, mica-shaped iron oxide, bronze, stainless steel, etc.

The preferred amount of the metallic flake pigment is usually about 1 to about 50 parts by weight per 100 parts by weight of the solids in the thermosetting resin composition. The high solids metallic coating composition is preferably in the form of either an organic solvent solution or a nonaqueous dispersion.

The high solids metallic coating composition can be applied in the same manner as in application of the nonmetallic coating composition. The preferred viscosity of the composition ranges from about 10 to about 40 seconds in terms of Ford cup #4 at 20° C. and the preferred thickness thereof is about 5 to about 25μ when it is thermally cured.

The high solids metallic coating composition is preferably compatible with the nonmetallic coating composition. More specifically, it is desirable that the thermosetting resin composition present in the high solids metallic coating composition comprise components which are partially or wholly the same as or similar to those for the resin composition in the nonmetallic coating composition or which, if different from the latter, are compatible therewith.

(3) Clear Thermosetting Coating Composition According to this Invention (Topcoating)

The topcoating is a composition to be applied over the high solids metallic coat to form a clear topcoat. The preferred topcoatings are those capable of forming a topcoat outstanding in gloss, weatherability, acid resistance, alkali resistance, solvent resistance, warm water resistance and like properties. More specifically, preferred examples of such topcoatings are those of the organic solvent solution or nonaqueous dispersion type which contain as a vehicle component a thermosetting resin composition comprising acrylic resin (base resin) and amino resin (cross linking agent) and which may further incorporate an ultraviolet light absorber, coloring agent and the like, when required.

To preclude the mottle of simulated metallic texture, it is preferred to use a topcoating containing a vehicle component which is low in compatibility with the thermosetting resin present in the high solids metallic coating composition. For example, when acrylic resin is used as a base resin, the solubility parameter (SP value) of acrylic resin in the topcoating is preferably lower by about 0.1 to about 1.0 than in the high solids metallic coating composition.

The preferred topcoating is formulated as a high solids type to give goods results in preventing air pollution and saving resources which are some of the objects of this invention. More specifically the topcoatings may be those giving a solids concentration of about 35 to about 70% by weight, preferably about 40 to about 60% by weight, more preferably about 45 to about 60% by weight.

The topcoating is applied in the same manner as in application of the nonmetallic coating composition. A suitable viscosity of the topcoating is about 15 to about 60 seconds in terms of Ford cup #4 at 20° C. and an appropriate thickness thereof is about 5 to about 50μ when it is thermally cured.

According to the coating method of this invention, the nonmetallic coating composition is applied directly to an article to be coated, or to the primed surface of an article to be coated or the intercoat over the primer on an article to be coated to form a first layer, the high solids metallic coating composition is applied to the first layer having a viscosity of about 3 to about 500 poises to form a second layer, the topcoating is applied to the second layer to form a third layer, and the coated article is heated to cure the three layers at the same time. The curing temperature is usually in the range of about 80 to about 180° C., preferably about 100 to about 180° C. The curing time generally ranges from about 5 to about 60 minutes, preferably about 15 to about 45 minutes.

The coatings thus formed, although containing the metallic coating composition with a high solids content, have the metallic flake pigment uniformly and regularly orient in parallel with the coating surface over the entire coating surface which results in coatings free of the mottle of simulated metallic texture and with a smooth surface which leads to an appearance having distinctness-of-image gloss.

This invention will be described below in more detail with reference to the following examples in which the parts and percentages are all by weight.

I. PREPARATION EXAMPLES

(A) Examples for Preparation of Base Resin Solutions

(1) Acrylic Resin Solution A-1

Fifteen parts of styrene, 15 parts of methyl methacrylate, 49 parts of ethyl acrylate, 20 parts of hydroxyethyl acrylate and 1 part of acrylic acid were subjected to polymerization in xylene using α,α'-azobisisobutyronitrile as a polymerization initiator to prepare an acrylic resin solution A-1 having a 70% resin content. The acrylic resin had a number-average molecular weight of about 10000.

(2) Acrylic Resin Nonaqueous Dispersion B-1

Seventy parts of a vinyl monomer mixture of 30 parts of styrene, 30 parts of methyl methacrylate, 23 parts of 2-ethylhexyl acrylate, 15 parts of 2-hydroxyethyl acrylate and 2 parts of acrylic acid was subjected to dispersion polymerization in n-heptane in the presence of 30 parts of a dispersion stabilizer to obtain an acrylic resin nonaqueous dispersion B-1 having a 50% resin content. The dispersion stabilizer used was a copolymer comprising 30 parts of an adduct of poly-12-hydroxystearic acid with glycidyl methacrylate, 10 parts of styrene, 20 parts of methyl methacrylate, 17 parts of 2-ethylhexyl methacrylate, 20 parts of 2-hydroxyethyl methacrylate and 3 parts of acrylic acid.

(3) Acrylic Resin Solution A-2

Forty parts of cellosolve acetate was placed in a reactor equipped with a stirrer, thermometer, reflux condenser, etc. and the content was stirred with heating until the temperature reached 135° C. whereupon the following monomer mixture was added over 3 hours thereto.

| | Amount (part) |
|---|---|
| Methyl methacrylate | 10 |
| i-Butyl methacrylate | 30 |
| n-Butyl methacrylate | 12 |
| 2-Ethylhexyl methacrylate | 20 |
| 2-Hydroxyethyl methacrylate | 25 |
| Methacrylic acid | 3 |
| Cellosolve acetate | 50 |
| α,α'-Azobisisobutyronitrile | 4 |

For 1 hour following the addition of the monomer mixture, the reaction was continued at 135° C. and a mixture of 10 parts of cellosolve acetate and 0.6 part of α,α'-azobisisobutyronitrile was added to the reaction mixture over one hour and 30 minutes. The mixture was maintained at 135° C. for 2 hours, and the cellosolve acetate was distilled off under reduced pressure to adjust the resin concentration to 65%, giving an acrylic resin solution A-2 having a viscosity of $Z_2$ (as measured by Gardner bubble viscometer at 25° C.). The acrylic resin thus obtained had a number-average molecular weight of about 6100 (measured by vapor pressure permeation method).

(4) Acrylic Resin Nonaqueous Dispersion B-2

Into a reactor were placed 126 parts of melamine, 412 parts of butyl formaldehyde (40%), 190 parts of n-butanol and 36 parts of xylene, and the mixture was heated at about 80° C. for 7 hours while separating the water evaporated with use of a water separator. The pressure of the system was reduced and 100 parts of the distillate was removed. To the residue were added 50 parts of n-hexane and 50 parts of n-heptane, giving a melamine resin solution having a 60% resin content and varnish viscosity J (as measured by Gardner bubble viscometer at 25° C.).

Into a reactor were placed 58 parts of the melamine resin solution, 30 parts of n-heptane and 0.15 part of benzoyl peroxide. The mixture was heated to 95° C. To the resulting mixture was added dropwise the following monomer mixture over 3 hours.

| | Amount (part) |
|---|---|
| Styrene | 15 |
| Acrylonitrile | 9 |
| Methyl methacrylate | 13 |
| Methyl acrylate | 15 |
| n-Butyl methacrylate | 1.8 |
| 2-Hydroxyethyl methacrylate | 10 |
| Acrylic acid | 1.2 |
| Benzoyl peroxide | 0.5 |
| n-Butanol | 5 |
| n-Hexane | 30 |
| n-Heptane | 9 |

One hour after the addition of the monomer mixture, a mixture of 0.65 part of t-butyl peroctoate and 3.5 parts of n-hexane was added dropwise over 1 hour. The mixture was stirred for 2 hours at the temperature maintained at 95° C. The pressure of the system was reduced and 34 parts of the solvent was removed, giving an acrylic resin nonaqueous dispersion B-2 with 60% resin content and varnish viscosity A (as measured by Gardner bubble viscometer at 25° C.).

(5) Alkyd Resin Solution C

Into a reactor were placed 31 parts of neopentyl glycol, 7 parts of trimethylolpropane, 24 parts of phthalic anhydride, 17 parts of hexahydrophthalic anhydride, 15 parts of fatty acid of castor oil and 5 parts of trimellitic anhydride. The mixture was subjected to reaction at 200° to 230° C. for 5 hours. To the reaction mixture was added 5 parts of phthalic anhydride and the mixture was reacted at 130° C. for 1 hour, giving an alkyd resin. To 100 parts of the alkyd resin were added 21 parts of xylene and 21 parts of isobutanol to obtain an alkyd resin solution C having a resin content.

(B) Examples for Preparation of Coating Compositions (1) Nonmetallic Coating Composition A

| | Amount (part) |
|---|---|
| 70% Acrylic resin solution A-1 | 100 |
| 88% "CYMEL 370" (trademark, melamine resin of Mitsui Toatsu Chemicals, Inc., Japan) | 34 |

The foregoing two components were mixed together and the mixture was adjusted to a viscosity of seconds (Ford cup #4 at 20° C.) with a solvent mixture comprising 40 parts of xylene, 30 parts of "Swasol #1000" (trademark, product of Maruzen Oil Company, Limited, Japan), 20 parts of ethyl acetate and 10 parts of isobutanol. The solids content in the mixture was 45%.

(2) Nonmetallic Coating Composition B

| | Amount (part) |
|---|---|
| 70% Acrylic resin solution A-1 | 29 |
| 50% acrylic resin nonaqueous dispersion B-1 | 120 |
| 88% "CYMEL 370" | 23 |

The foregoing three components were mixed together and the mixture was adjusted to a viscosity of 25 seconds (Ford cup #4 at 20° C.) with a solvent mixture comprising 30 parts of xylene, 30 parts of "Swasol #1000," 10 parts of butyl cellosolve, 10 parts of isobutanol and 20 parts of ethyl acetate. The solids content in the mixture was 52%.

(3) Nonmetallic Coating Composition C

| | Amount (part) |
|---|---|
| 70% Alkyd resin solution C | 100 |
| 88% "CYMEL 370" | 34 |

The foregoing two components were uniformly mixed and the mixture was adjusted to a viscosity of 30 seconds (Ford cup #4 at 20° C.) with a solvent mixture comprising 30 parts of toluene, 35 parts of ethyl acetate, 10 parts of isobutanol and 15 parts of "Swasol #1000". The solids content in the mixture was 55%

(4) High Solids Metallic Coating Composition M-1

| | Amount (part) |
|---|---|
| 70% Acrylic resin solution A-1 | 29 |
| 50% Acrylic resin nonaqueous dispersion B-1 | 120 |
| 88% "CYMEL 370" | 23 |
| Aluminum paste A (product of Toyo Aluminium K. K., Japan, available under a trademark "Alpaste Super Brilliant 1830 YL") | 20 |
| Carbon black (product of Columbian Carbon Japan, Ltd., Japan, available under a trademark "Neo Spectra Beads AG") | 0.005 |

The foregoing components were mixed together and dispersed and the dispersion was adjusted to a viscosity of 5 seconds (Ford cup #4 at 20° C.) with a solvent mixture comprising 30 parts of n-heptane, 30 parts of xylene, 30 parts of "Swasol #1000" and 10 parts of butyl cellosolve. The solids content in the mixture was 50%.

(5) High Solids Metallic Coating Compositions M-2 to M-4

TABLE 1

| | 70% Acrylic resin solution A-1 (part) | 50% Acrylic resin non-aqueous dispersion B-1 (part) |
|---|---|---|
| M-2 | 43 | 100 |
| M-3 | 57 | 80 |
| M-4 | 71 | 60 |

High solids metallic coating compositions M-2 to M-4 were prepared in the same manner as in preparation of high solids metallic coating composition M-1 except that two components were used in the amounts as listed above in Table 1. The viscosity of the compositions was adjusted to 15 seconds (Ford cup #4 at 20° C.). The solids contents were 47%, 42% and 37% in the M-2, M-3 and M-4 coating compositions, respectively.

(6) Topcoating A

A topcoating A was prepared by dispersing the following components including the acrylic resin solution A-2.

| | Amount (part) |
|---|---|
| 65% Acrylic resin solution A-2 | 108 |
| 70% "UVAN 20HS" (trademark, melamine resin of Mitsui Toatsu Chemicals, Inc., Japan) | 43 |
| 60% Acrylic resin nonaqueous dispersion B-2 | 54 |

The topcoating prepared above was adjusted to a viscosity of 35 seconds (Ford cup #4 at 20° C.) with a solvent mixture comprising 35 parts of "Swasol #1000," 5 parts of butyl cellosolve and 30 parts of n-butanol. The topcoating A had a solids content of 53%. The topcoating A is lower in SP value of acrylic resin by 0.3, 0.1, 0.2 and 0.3 than the high solids metallic coating compositions M-1, M-2, M-3 and M-4, respectively.

EXAMPLE 1

An electrophoretic coating composition of polybutadiene type was electrodeposited to a dull-finish steel plate treated with zinc phosphate and having a thickness of 0.8 mm to form a dry film having a thickness of 20μ. The coated plate was baked at 170° C. for 20 minutes, polished with sand paper (#400) and degreased by wiping with petroleum benzine. An aminopolyester-type intercoat surfacer for automobiles ("Amilac N-2 sealer," product of Kansai Paint Company, Limited, Japan) was applied to the coated plate by air spray to a thickness of about 25μ when dried. The plate thus coated was baked at 140° C. for 30 minutes, subjected to wet grinding with sand paper (#400) and was dried by dewatering. The dried plate was degreased with petroleum benzine to provide a test substrate.

The nonmetallic coating composition A was applied to the test substrate with use of "Minibell G," (trademark, electrostatic coater of rotation type manufactured by Nippon Ransburg, Japan) to a thickness of 5 to 10μ when cured. The test substrate thus coated was left to stand at ambient temperature for 2 minutes (with the coating having a viscosity of 37 poises/20° C.), and the high solids metallic coating composition M-1 was applied to the coated test substrate with "REA" (trademark of electrostatic air spray manufactured by Nippon Ransburg, Japan) to a thickness of 10 to 15μ when cured. After standing at ambient temperature for 3 minutes, the topcoating A was applied to the coated test substrate with "Minibell G" to a thickness of 35 to 40μ when cured. After standing at ambient temperature for 10 minutes, the coated test substrate was heated at 140° C. by an electric hot-air drier for 30 minutes to cure the coatings.

EXAMPLES 2 TO 5

The test substrate was coated in the same manner as in Example 1 with the coating compositions as listed below in Table 2. The coated test substrate was heated in the same manner as in Example 1 to cure the coatings. Four kinds of coated test substrates were prepared in this way. Table 2 below shows the type of nonmetallic coating compositions, high solids metallic coating compositions and topcoatings as used, the viscosity of nonmetallic coating composition remaining in the specific range at the time of application of high solids metallic coating composition, the solids content of all coating compositions, and the results of ratings of appearance of the finish exteriors.

COMPARATIVE EXAMPLE 1 TO 4

The high solids metallic coating composition as shown below in Table 2 was applied directly to the test substrate with use of "REA" to a thickness of 10 to 15μ when cured. The test substrate thus coated was left to stand at ambient temperature for 3 minutes and the topcoating A was applied to the coated test substrate with "Minibell G" to a thickness of 35 to 40μ when cured. After standing at ambient temperature for about 10 minutes, the coated test substrate was heated at 140° C. for 30 minutes with an electric hot-air drier to cure the coatings, giving a coated test substrate. In the same manner, four kinds of coated test substrates were prepared using the high solids metallic coating compositions as shown below in Table-1 which also indicates the the solids contents of all compositions in application and the results of ratings of appearance of finish exteriors.

TABLE 2

| | Examples | | | | | Comparative Examples | | | |
|---|---|---|---|---|---|---|---|---|---|
| | 1 | 2 | 3 | 4 | 5 | 1 | 2 | 3 | 4 |
| Nonmetallic coating comp. | | | | | | | | | |
| Kind of coating comp. | A | B | C | B | B | — | — | — | — |
| Solids content (%) (1) | 45 | 52 | 55 | 52 | 52 | — | — | — | — |
| Viscosity of nonmetallic coating comp. at the time of appln. of high solids metallic coating comp. (2) | 37 | 48 | 15 | 48 | 48 | — | — | — | — |
| High solids metallic coating comp. | | | | | | | | | |
| Kind of coating comp. | M-1 | M-1 | M-1 | M-2 | M-3 | M-1 | M-2 | M-3 | M-4 |
| Solids content (%) (1) | 50 | 50 | 50 | 47 | 42 | 50 | 47 | 42 | 37 |
| Topcoating | | | | | | | | | |
| Kind of coating comp. | A | A | A | A | A | A | A | A | A |
| Solids content (%) (1) | 53 | 53 | 53 | 53 | 53 | 53 | 53 | 53 | 53 |
| Test results | | | | | | | | | |
| Mottle of metallic texture (3) | A | A | A | A | A | D | D | C | C |
| Brightness of metallic texture (4) | 62.52 | 63.10 | 62.85 | 63.87 | 64.30 | 52.68 | 53.20 | 56.32 | 56.81 |
| Gloss (5) | 92.5 | 92.3 | 92.6 | 92.4 | 92.5 | 85.6 | 85.8 | 88.5 | 91.7 |
| Distinctness-of-image gloss (6) | 1.0 | 1.0 | 1.0 | 1.0 | 1.0 | 0.4 | 0.4 | 0.6 | 0.7 |

The details of (1)–(6) in Table 2 are as follows.

(1) The solids content (%) was measured according to JIS K5400, 8.2.

(2) The viscosity of nonmetallic coating composition at the time of application of high solids metallic coating composition was measured by applying the nonmetallic coating composition to a tinplate under the same conditions as above, collecting the composition in a bottle after standing for 2 minutes and measuring the viscosity (poise, 20° C.) of the collected composition with a viscometer of the cone and plate type at a shear rate of 10 $sec^{-1}$.

(3) The mottling of simulated metallic texture was measured by observing the coating surface (30 × 45 cm) with unaided eye according to the following ratings.

A: The metallic flake pigment was evenly orientated in parallel with the coating surface and no mottling of metallic texture was found.

B: A little mottling of metallic texture was clearly seen.

C: Mottling of metallic texture was detected over ⅓ to ½ the area of coating surface.

D: Mottling of metallic texture existed over substantially the entire area of coating surface.

(4) The brightness of simulated metallic texture was measured with a color-difference meter and indicated in terms of L value. The degree of brightness is greater as a higher value is recorded.

(5) The gloss was measured with a reflection coefficient of 20°.

(6) The distinctness-of-image gloss was measured with "JCRI-GGD-166 Model," Gd meter (sold by Japan Color Research Institute, Japan) at an angle of 55°.

The details of (1)–(6) in Table 2 are as follows.

(1) The solids content (%) was measured according to JIS K 5400, 8.2.

(2) The viscosity of nonmetallic coating composition at the time of application of high solids metallic coating composition was measured by applying the nonmetallic coating composition to a tinplate under the same conditions as above, collecting the composition in a bottle after standing for 2 minutes and measuring the viscosity (poise, 20° C.) of the collected composition with a viscometer of the cone and plate type at a shear rate of 10 $sec^{-1}$.

(3) The mottling of simulated metallic texture was measured by observing the coating surface (30×45 cm) with unaided eye according to the following ratings.

A: The metallic flake pigment was evenly orientated in parallel with the coating surface and no mottling of metallic texture was found.

B: A little mottling of metallic texture was clearly seen.

C: Mottling of metallic texture was detected over ⅓ to ½ the area of coating surface.

D: Mottling of metallic texture existed over substantially the entire area of coating surface.

(4) The brightness of simulated metallic texture was measured with a color-difference meter and indicated in terms of L value. The degree of brightness is greater as a higher value is recorded.

(5) The gloss was measured with a reflection coefficient of 20°.

(6) The distinctness-of-image gloss was measured with "JCRI-GGD-166 Model," Gd meter (sold by Japan Color Research Institute, Japan) at an angle of 55°.

I claim:

1. A metallic coating method comprising the steps of: (i) applying a thermosetting polymer coating composition containing no metallic flake pigment to an article to be coated to form a first layer, said polymer coating composition being a non-aqueous dispersion or solution, (ii) applying a high solids thermosetting polymer metallic coating composition to the first layer to form a second layer while the viscosity of the first layer is about 3 to about 5 poises at 20° C., (iii) applying a clear thermosetting polymer coating composition to the second layer to form a third layer, and (v) heating the coated article to cure the three layers at the same time.

2. A coating method as defined in claim 1 wherein the thermosetting polymer coating composition containing no metallic flake pigment has a solids concentration of about 35 to aobut 70% by weight.

3. A coating method as defined in claim 1 wherein the first layer has a thickness of about 2° to about 20° when thermally cured.

4. A coating method as defined in claim 1 wherein the second layer is applied while the viscosity of the first layer is about 5 to about 100 poises at 20° C.

5. A coating method as defined in claim 4 wherein the second layer is applied while the viscosity of the first layer is about 10 to about 50 poises at 20° C.

6. A coating method as defined in claim 1 wherein the high solids thermosetting metallic coating composition has a solids concentration of about 35 to about 70% by weight.

7. A coating method as defined in claim 6 wherein the high solids thermosetting metallic coating composition has a solids concentration of about 40 to about 60% by weight.

8. A coating method as defined in claim 1 wherein the second layer has a thickness of about 5 to about 25μ when thermally cured.

9. A coating method as defined in claim 1 wherein the clear thermosetting polymer coating composition has a solids concentration of about 35 to about 70% by weight .

10. A coating method as defined in claim 1 wherein the third layer has a thickness of about 5 to about 50μ when thermally cured.

11. A coating method as defined in claim 1 wherein the coated article is heated at about 80° to about 180° C. for about 5 to about 60 minutes to cure the three layers.

12. A coating method as defined in claim 1, wherein the thermosetting polymer coating composition containing no metallic flake pigment excludes a primer composition.

* * * * *